US005280909A

United States Patent [19]

Tracy

[11] Patent Number: 5,280,909

[45] Date of Patent: Jan. 25, 1994

[54] GAMING SYSTEM WITH PROGRESSIVE JACKPOT

[75] Inventor: Daniel A. Tracy, Las Vegas, Nev.

[73] Assignee: Mikohn, Inc., Nev.

[21] Appl. No.: 831,945

[22] Filed: Feb. 6, 1992

[51] Int. Cl.[5] ..... A63F 9/22; A63F 5/04

[52] U.S. Cl. ..... 273/138 A

[58] Field of Search ..... 273/138 R, 138 A, 143 R, 273/85 CP

[56] References Cited

U.S. PATENT DOCUMENTS

| | | | |
|---|---|---|---|
| 4,775,937 | 10/1988 | Bell | 273/138 A |
| 4,837,728 | 6/1989 | Barrie et al. | 273/138 A |
| 4,844,464 | 7/1989 | Berge | 273/143 R |
| 4,861,041 | 8/1989 | Jones et al. | 273/85 CP |
| 4,964,638 | 10/1990 | Ishida | 273/138 A |
| 5,016,880 | 5/1991 | Berge | 273/138 A |
| 5,042,810 | 8/1991 | Williams | 273/138 A |
| 5,048,833 | 9/1991 | Lamle | 273/138 A |
| 5,078,405 | 1/1992 | Jones et al. | 273/85 CP |
| 5,116,055 | 5/1992 | Tracy | 273/138 A |
| 5,123,649 | 6/1992 | Tiberio | 273/143 R |

*Primary Examiner*—Jessica J. Harrison

*Attorney, Agent, or Firm*—Robin, Blecker, Daley & Driscoll

[57] ABSTRACT

A gaming system in which a plurality of gaming machines are provided with an additional progressive jackpot gaming system which allows players on the gaming machines to play for a jackpot provided by the progressive system. The controller of the progressive system generates in random fashion at the beginning of a game cycle a jackpot-win value for the progressive jackpot which is displayed to the players of the gaming machine from the beginning of the game cycle. The controller also randomly generates a parameter for use with unit bet information from the gaming machines in determining a current jackpot value. When the current jackpot value is brought to the jackpot-win value, the gaming machine responsible is the winner of the progressive jackpot. Also disclosed is the generation by the progressive controller of signalling which is supplied to a winning gaming machine and causes the machine to make the jackpot payout.

58 Claims, 1 Drawing Sheet

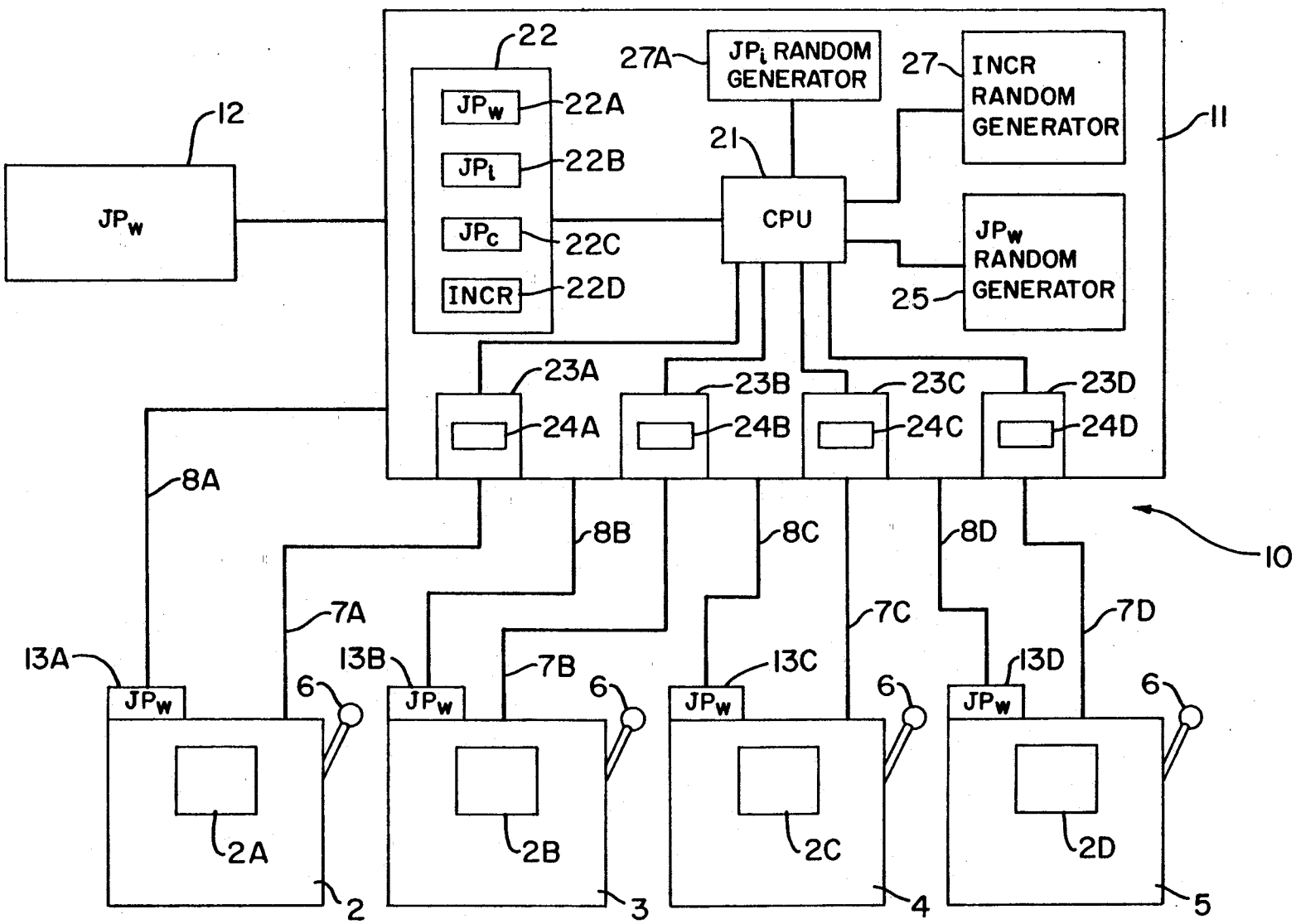
10
11
INCR RANDOM GENERATOR
27
JPw RANDOM GENERATOR
25
JPl RANDOM GENERATOR
27A
CPU
21
22
22A
22B
22C
22D
JPw
JPl
JPc
INCR
23A
24A
23B
24B
23C
24C
23D
24D
8A
8B
8C
8D
7A
7B
7C
7D
13A
13B
13C
13D
JPw
2
2A
3
2B
4
2C
5
2D
6
12
JPw

GAMING SYSTEM WITH PROGRESSIVE JACKPOT

BACKGROUND OF THE INVENTION

This invention relates to gaming systems and, in particular, to gaming systems in which a progressive jackpot is utilized.

In a traditional gaming machine or device, such as, for example, a slot machine, poker machine, keno machine, etc., the player inserts monetary amounts by coin, token, paper currency or other entry (e.g., automatic entry by pushing a button) to play one or more games on the gaming machine. These monetary amounts are usually translated into a number of units of the lowest unit of currency receivable by the machine, referred to herein as the unit bet. Translation into unit bets is typically carried out by representing each unit bet as a single pulse so that the generation of N pulses would correspond to a currency entry equal to N unit bets. Thus, in a gaming machine whose unit bet equals $0.25, entry of a dollar would amount to 4 unit bets, resulting in the generation of 4 pulses.

Upon entry of a monetary amount, the gaming machine examines the generated unit bet pulses and determines therefrom which games and/or awards the player qualifies for. The player is then normally required to take some action (e.g., pulling the lever arm in a slot machine) to institute playing of the game.

Once the player takes this action, the gaming machine carries out the necessary activities for its game cycle which might require certain further actions and choices by the player. Once these activities are completed, the gaming machine determines whether the player has won the game or not (e.g., in a slot machine whether one or more reels have a winning combination or not). If the game has been won, the player is given the award established by the gaming machine for the particular game being played. Typically, the award is a return of monetary amounts in excess of the amounts entered to play the game. Once the gaming machine completes payout for a won game or determines that the player has not won, the gaming cycle has been completed. The gaming machine then resets so as to be able to again receive monetary amounts to begin another game cycle.

In order to stimulate play on the gaming machines, a so-called "progressive gaming system" has been added in which, in addition to the normal games being played on each of the gaming machines, the machines are linked together so that in playing on the machines, players compete for an additional common award or jackpot. In this type of system, a programmed controller is provided for linking the machines together. The controller receives from the machines unit bet and machine identification information and supplies to the players, either through displays provided on the respective machines and/or a common overhead display, information as to the common jackpot.

The controller of the system controls the progressive game during each game cycle by first establishing a jackpot-win amount or value in a random manner from between maximum and minimum jackpot values. The controller then also establishes a base value which is used as an initial amount for a current jackpot amount, which is the jackpot amount reported by the controller to the machine displays and/or the overhead display and displayed to the players. The current jackpot amount is recalculated or incremented by the controller each time a game is played at each gaming machine. The controller does this by adding to the current jackpot amount an increment value based on the number of unit bets entered at the particular gaming machine multiplied by a fixed increment rate per unit bet.

To this end, each gaming machine, as above-indicated, reports its unit bet information to the controller upon a player playing the machine so that the current jackpot value can be appropriately incremented. The gaming machine is also identified to the controller with the bet information so that the controller knows which gaming machine resulted in the increment.

After each increment of the current jackpot, the controller compares the new current jackpot value with the jackpot-win value which it previously randomly established and stored. If the new value is less than the jackpot-win value, the controller merely updates the current jackpot value and communicates the updated value to the displays at the gaming machines and/or the overhead display. The controller then continues to monitor the unit bet information indicative of game play from the gaming machines and to increment the current jackpot value based thereon.

When an increment to the current jackpot value causes the value to reach or become equal to the jackpot-win value, the controller determines that the jackpot has been won by the gaming machine which resulted in the increment. The controller communicates this to the winning gaming machine and the appropriate payment of the jackpot-win amount is made to the player.

After a jackpot has been won, the controller then institutes a new game cycle in which it resets the progressive jackpot by randomly selecting from values between the maximum and minimum jackpot values a new jackpot-win value. The controller then also resets the current jackpot value to the base value and begins incrementing this value based on the fixed increment and the game play (as evidenced by the unit bet information) of the linked machines. As before, this incrementing continues until the current jackpot value reaches the new jackpot-win value and the progressive jackpot is again won. The controller then repeats the progressive game cycle based on continued game play, as above-described.

The above type of progressive system has been sold by the assignee of the present application under the name Mikohn Mystery Progressive Jackpot System in which the programmed controller used is a Mikohn Model No. CONT-2 controller. While this system and its added jackpot have proved satisfactory in stimulating game play on the linked gaming machines, it has been observed that game play tends to decrease immediately after the progressive jackpot has been won. Not until the displayed current jackpot value increases considerably above the initially reset base value does game play increase to its more usual levels. This fall-off in game play is a result of the players on the gaming machines being reluctant to institute game play when the displayed current jackpot value is close to the initial base value, since they know that the value will likely increase to a more substantial level.

Fall-off in game play at any time is of course undesirable and detracts from the benefits of the added progressive gaming system. Another detracting feature of the progressive system is that the pay-out at a winning machine has to be manually performed by gaming personnel, once a machine has been identified as winning the added jackpot. This limits the overall adaptability of the system. As a result, while the aforesaid mystery progressive jackpot system provides some degree of stimulation for game play, there is still a continued effort to develop additional ways to increase player interest.

It is, therefore, an object of the present invention to provide an improved progressive jackpot gaming system of the above type.

It is a further object of the present invention to provide a progressive jackpot gaming system of the above type which has been modified to further stimulate game play.

It is yet a further object of the present invention to provide a progressive jackpot gaming system of the above type which has been modified to attempt to lessen fall-off in game play after the progressive jackpot has been won.

It is still further object of the present invention to provide a progressive gaming system of the above type in which payout of the progressive jackpot at a gaming machine is more readily accomplished.

SUMMARY OF THE INVENTION

In accordance with the principles of the present invention, the above and other objectives are realized, in part, in a gaming system of the above-type in which the controller of the system is modified such that at the beginning of each progressive game cycle it enables the gaming machine displays and/or overhead display to display the jackpot-win value which has been established for the game cycle. The controller of the system is additionally adapted so that the current jackpot value for a given progressive game cycle is also randomly established. This can be effected for each game cycle by randomly selecting one or more parameters such as the increment rate and/or the base value, used to determine the current jackpot value.

With the controller so adapted, the players on the gaming machines are immediately made aware of the added jackpot they can win by playing on their respective machines. As a result, players are no longer presented with a low initial or base value which could cause them to not play at the beginning of a game cycle. Lessened play at this time is thus reduced. Also by randomly establishing the current jackpot value, it remains difficult for players to predict the number of unit bets needed to reach the displayed jackpot-win value. Thus, the unpredictable nature of the progressive game is preserved.

In a further aspect of the present invention, a controller for the above type of system is adapted to provide signalling information to a winning gaming machine so as to enable and cause, the machine to automatically provide the jackpot win value payout from the machine itself. With this modification, each gaming machine is also adapted to respond to the signalling information. As a further aspect of this modification, payout need not be based on a jackpot-win value, but upon other predetermined conditions or criteria which determine the jackpot value.

BRIEF DESCRIPTION OF THE DRAWINGS

The above and other features and aspects of the present invention will become more apparent upon reading the following detailed description in conjunction with the accompanying drawings, in which:

FIG. 1 shows a progressive gaming system in accordance with the principles of the present invention.

DETAILED DESCRIPTION

FIG. 1 shows a plurality of gaming machines 2-5 which are adapted for use with the progressive gaming system of the present, invention. As illustrated, each of the machines is a reel type slot machine having reels 2A, 2B, 2C and 2D respectively and the same unit bet, shown as $0.25.

In normal use, a number of unit bets are inserted into a machine and, depending upon the number inserted, the player plays for one or more awards or payouts. These awards or payouts depend upon certain combinations being displayed by the respective reels of the gaming machine when the game is played.

Each unit bet applied to a gaming machine is converted into an electrical pulse or signal to signify that the unit bet has been applied. The gaming machine then knows by the number of pulses generated which awards or payouts the player is playing for.

Initiating of a game cycle on each machine begins when the player pulls the machine handle 6, causing the respective reels to spin and stop at certain combinations which are displayed to the player. If the combinations developed are those for which an award or payout is to be made, the gaming machine provides the payout, which is usually some multiple of the unit bet.

In order to stimulate play on the gaming machines 2-5, a progressive jackpot system 10 is utilized. This progressive system enables the players playing on the machines 2-5 to compete for an additional jackpot which is reached as a result of game play at the machines, but which is not won based upon winning at the machines. As shown, the system 10 includes a programmed controller 11 which links the machines 2-5 and which establishes and controls the progressive jackpot. In the case shown, the system also includes a common display 12, as well as individual displays or meters 13A-13D, which are located at the gaming machines, all of which display the same jackpot information received from the controller 11 on lines 8A-8D, respectively.

In the present case, the controller 11 includes a central processing unit (CPU) 21, a memory 22 and communication interfaces 23A-23D which include storage buffers or registers 24A-24D. The latter interfaces receive and transmit information from and to lines 7A-7D which are connected to the gaming machines 2-5. The lines 7A-7D and corresponding interfaces 23A-23D serve as identification to the controller 11 that the information being received is attributable to a particular gaming machine.

The controller 11 also includes a jackpot-win value generator 25 which establishes the jackpot-win value, $JP_w$, for the jackpot of the progressive system. In the present case, the generator 25 is a random generator which randomly establishes in standard fashion the value $JP_w$ from between maximum and minimum jackpot values JPmax and JPmin.

The jackpot-win value $JP_w$ is stored in a register 22A of the memory 22 for use by the controller 11 during game play on the machines to establish whether the progressive jackpot has been won. Also stored by the controller 11 in further registers 22B, 22C and 22D of the memory 22 is a base or initial jackpot value, $JP_i$, a current jackpot value, $JP_c$ and an increment per unit bet value, INCR, all of which are also used in determining whether the progressive jackpot has been won. At the start of each progressive game cycle, the value of $JP_c$ is set to $JP_i$.

As games are played on the gaming machines 2-5, unit bet information is developed by the machines in the form of the pulses as above-described, for use by the machines. This unit bet information is now also coupled over the lines 7A-7D to the registers 24A-24D in the interfaces 23A-23D. These registers are, in turn, periodically interrogated by the CPU 21 for newly received unit bet information.

When the CPU 21 arrives at a register having new unit bet information, the CPU then increments the stored current jackpot value, $JPC_c$, by adding to it an increment value, INC in accordance with the following expression:

INC=UNIT BETS IN REGISTER BEING INTERROGATED * INCR

The CPU 21 stores the incremented value of $JP_c$ in the register 22C. The CPU then compares the newly stored incremented value of $JP_c$ with the jackpot win value $JP_w$ stored in the register 22A. If the value of $JP_c$ is less than the value of $JP_w$, the CPU 21 continues its interrogation of the interface registers for further incoming unit bet information as play on the machines 2-5 continues.

When a time is reached in which the unit bet information from a register results in an incremented value of $JP_c$ which equals $JP_w$, the CPU 21 determines that the progressive jackpot has been won. At this point, the particular gaming machine whose unit bet information resulted in the win is assessed the winner of the progressive game. The CPU 21 then advises the winning machine over the respective interface and line. The payout of the $JP_w$ amount is then manually made by gaming personnel to the player at the winning machine.

At this time, the CPU 21 begins a next game cycle. In doing so, it resets the value of $JP_c$ to $JP_i$ and then causes the generator 6 to randomly establish another $JP_w$ value. This value is then stored in the register 22A and will apply to the new machine cycle. The displays 12 and 13A-13D, which display the incremented current jackpot value $JP_c$, are also reset to $JP_i$ (the initial $JP_c$ value) by suitable signalling from the CPU 21. To this point, the above progressive system 10 is similar to the Mikohn mystery jackpot system discussed above and the programming and units used in the mystery system can be used to carry out the above functions in the system 10.

In accordance with the principles of the present invention, the system 10 is modfied in such a way as to stimulate game play at the machines 2-5 during the beginning of each progressive game cycle of the system 10. In particular, the CPU 21 of the controller is adapted such that it enables the $JP_w$ value established at the beginning of each game cycle to be displayed on the machine displays 13A-13D and the overhead display 12, instead of the current jackpot value $JP_c$, as in the above-described mystery system. Accordingly, at the beginning of each game cycle of the system 10 and during the game cycle, the $JP_w$ value generated by the generator 25 for the game cycle is caused by the CPU 21 to be displayed on each of the displays. As a result, player interest is not lessened by display of the value $JP_i$, as in the prior mystery system.

In cooperation with the display of the $JP_w$ value, the progressive system 10 is additionally adapted so as to enhance the element of unpredictably in the system, and, therefore, to make it difficult to predict when a win might occur. In accordance with the invention, this is accomplished by establishing the current jackpot value $JP_c$ in a random manner.

More particularly, in the present illustrative case, this randomness is provided by including in the controller 11 a further INCR random generator 27 and a further $JP_i$ random generator 27A. These generators are controlled by the CPU 21 and are used by the CPU to establish the INCR and $JP_i$ values for each progressive game cycle randomly from between maximum and minimum values $INCR_{max}$ and $INCR_{min}$ for INCR and maximum and minimum values $JP_{imax}$ and $JP_{imin}$ for $JP_i$.

With the above adaptations of the progressive system 10, upon initiating the system and upon resetting of the system after each progressive game cycle, the CPU 21 of the controller causes the generators 25 and 27 and 27A to randomly establish a $JP_w$ value, INCR and $JP_i$ values. As above-indicated, the $JP_w$ value is then displayed on the machine displays and overhead display from the beginning and during the progressive game cycle, so that players are always aware of the jackpot they are playing for.

The randomly established INCR and $JP_i$ values, in the meantime, are now used as before in establishing the $JP_c$ value. In particular, the $JP_i$ value is set as the initial $JP_c$ value. The INCR value, in turn, is used to determine the INC value for incrementing the $JP_c$ value (which, in the present case, is no longer displayed) as previously discussed above.

This incrementing of the $JP_c$ values continues until the $JP_c$ value reaches the $JP_w$ value and the jackpot is won. By utilizing an INCR and $JP_i$ values which are randomly determined for each progressive game cycle, the unpredictability of reaching the $JP_w$ value is preserved, even though it is now known to the players by its display.

It should be noted that the principles of the invention are applicable to the system 1 modified to utilize a fixed value for $JP_w$ for the different game cycles. Similarly, the invention can be practiced with one or the other of the $JP_i$ and INCR values fixed and the other randomly generated.

It should also be noted that while the present invention has been illustrated based upon the gaming machines 2-5 being slot machines, they could as well have been other types of gaming machines such as, for example, keno or poker machines. Also, while the communication of unit bet information has been illustrated in terms of pulses for each unit bet, other modes of communication of this information, such as multiplexed pulse code modulation transmission could also have been employed.

Also, the gaming machines need not all be of the same unit bet character and the system can be modified to operate with machines having mixed characteristics as disclosed in U.S. applcation Ser. No. 725,001 assigned to the same assignee hereto.

In a further aspect of the invention, the controller 11 is further modified such that the signalling conveyed to a gaming machine which has been determined as a winner of the progressive jackpot, not only indicates that the gaming machine has won the jackpot, but also includes payout and control signal information for enabling the gaming machine to itself make the payout.

With this modification each gaming machine is itself adapted to recognize and respond to the payout and control signal information from the controller and to make the required payout. In gaming machines which are program controlled such as, for example, the IGT Players Edge Poker Machines, this can be effected by suitable modification of the programming to recognize the payout and control signal information and make the required payout.

Additionally, with this type of system, the payout need not be based on a fixed or randomly generated jackpot-win value. Instead, the payout can be based on other predetermined criteria which the gaming machine can assess and follow in making a payout in response to the control signal in the signalling information. These criteria can include, for example, conditions at the gaming machine itself. In particular, as an illustration, the payout criteria might be to pay out a jackpot equal to the award for the next winning combination established at the gaming machine. In this case, the gaming machine awaits until a next winning combination occurs at the machine itself and then pay out twice the award. One award would be based on win at the machine and the other on the win of the progressive game.

Thus, with the controller adapted to provide the aforesaid signalling information to the gaming machines and the machines adapted to respond to this signalling information, a wide variety of payouts and criteria for determining these payouts can be automatically effected by the machines themselves without the aid of gaming personnel.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A gaming system comprising:

a plurality of gaming machines, each gaming machine generating unit bet information indicative of a number of unit bets supplied to the machine for playing a game on the machine;

a progressive jackpot system having a repeating game cycle, said progressive jackpot system during each game cycle providing a jackpot equal to a jackpot-win value and which can be won as a result of play on said gaming machines by one of said gaming machines, said progressive jackpot system including: progressive control means responsive to the unit bet information generated by said gaming machines and which during each game cycle: establishes at the beginning of the game cycle a jackpot-win value; enables said jackpot-win value to be displayed from said beginning of and during said game cycle; randomly establishes at the beginning of the game cycle a parameter for determining a current jackpot value; determines said current jackpot value based on unit bet information from the gaming machines and said randomly established parameter; and determines that a particular gaming machine has won the jackpot when the current jackpot value is brought to the jackpot-win value as a result of unit bet information from the particular gaming machine.

2. A gaming system in accordance with claim 1 wherein:

said progressive jackpot system further includes:

display means responsive to said progressive control means for displaying said jackpot-win value so as to be viewable by the players playing said gaming machines.

3. A gaming system in accordance with claim 2 wherein:

said display means includes an overhead display.

4. A gaming system in accordance with claim 2 wherein:

said display means includes an individual display at each of said gaming machines.

5. A gaming system in accordance with claim 1 wherein:

said progressive control means communicates to said particular gaming machine that the particular gaming machine has won the jackpot.

6. A gaming system in accordance with claim 1 wherein:

said progressive control means randomly establishes said jackpot-win value.

7. A gaming system in accordance with claim 6 wherein:

said parameter is an initial base value for said current jackpot value;

and said control means determines said current jackpot value by incrementing said initial base value.

8. A gaming system in accordance with claim 6 wherein:

said parameter is an increment rate per unit bet; and said control means determines said current jackpot value by incrementing an initial base value based on said increment rate per unit bet and said unit bet information from said gaming machines.

9. A gaming system in accordance with claim 6 wherein:

said progressive control means randomly selects said jackpot-win value from between a maximum jackpot-win value and a minimum jackpot-win value.

10. A gaming system in accordance with claim 1 wherein:

said progressive control means establishes the same jackpot-win value for each game cycle.

11. A gaming system in accordance with claim 10 wherein:

said parameter is an initial base value for said current jackpot value; and said control means determines said current jackpot value by incrementing said initial base value.

12. A gaming system in accordance with claim 10 wherein:

said parameter is an increment rate per unit bet, and said control means determines said current jackpot value by incrementing an initial base value based on said increment rate per unit bet and said unit bet information from said gaming machines.

13. A gaming system in accordance with claim 1 wherein:

said parameter is an initial base value for said current jackpot value; and said control means determines said current jackpot value by incrementing said initial base value.

14. A gaming system in accordance with claim 13 wherein:

said progressive control means randomly selects said initial base value from between a maximum initial base value and a minimum initial base value.

15. A gaming system in accordance with claim 1 wherein: said parameter is an increment rate per unit bet; and said control means determines said current jackpot value by incrementing an initial base value based on said increment rate per unit bet and said unit bet information from said gaming machines.

16. A gaming system in accordance with claim 15 wherein:

said progressive control means randomly selects said increment rate per unit bet from between a maximum increment rate per unit bet and a minimum increment rate per unit bet.

17. A method of operating a gaming system, the gaming system comprising: a plurality of gaming machines, each gaming machine generating unit bet information indicative of a number of unit bets supplied to the machine for playing a game on the machine; and a progressive jackpot system having a repeating game cycle, said progressive jackpot system during each game cycle providing a jackpot equal to a jackpot-win value and which can be won as a result of play on said gaming machines by one of said gaming machines; said method for each game cycle of the progressive jackpot system including:

establishing at the beginning of the game cycle a jackpot-win value;

enabling said jackpot-win value to be displayed from said beginning of and during said game cycle;

randomly establishing at the beginning of the said game cycle a parameter for determining a current jackpot value;

determining a current jackpot value based on unit bet information from the gaming machines and said randomly established parameter; and determining that a particular gaming machine has won the jackpot when the current jackpot value is brought to the jackpot-win value as result of unit bet information from the particular gaming machine.

18. A method in accordance with claim 17 further comprising:

displaying said jackpot-win value so as to be viewable by the players playing said gaming machines.

19. A method in accordance with claim 17 further comprising:

communicating to the particular gaming machine that the particular gaming machine has won the jackpot.

20. A method in accordance with claim 17 wherein: said step of establishing said jackpot-win value is carried out randomly.

21. A method in accordance with claim 20 wherein: said parameter is an initial base value for said current jackpot value; and said step of determining said current jackpot value is carried out by incrementing said initial base value.

22. A method in accordance with claim 20 wherein: said parameter is an increment rate per unit bet; and said control means determines said current jackpot value by incrementing an initial base value based on said increment rate per unit bet and said unit bet information from said gaming machines.

23. A gaming system in accordance with claim 20 wherein:

said jackpot-win value is selected from between a maximum jackpot-win value and a minimum jackpot-win value.

24. A method in accordance with claim 17 wherein: the same jackpot-win value is established for each game cycle.

25. A method in accordance with claim 24 wherein: said parameter is an initial base value for said current jackpot value; and said step of determining said current jackpot value is carried out by incrementing said initial base value.

26. A method in accordance with claim 24 wherein: said parameter is an increment rate per unit bet; and said control means determines said current jackpot value by incrementing an initial base value based on said increment rate per unit bet and said unit bet information from said gaming machines.

27. A method system in accordance with claim 17 wherein:

said parameter is an initial base value for said current jackpot value; and said step of determining said current jackpot value is carried out by incrementing said initial base value.

28. A method in accordance with claim 27 wherein: said initial base value is randomly selected from between a maximum initial base value and a minimum initial base value.

29. A method in accordance with claim 17 wherein: said parameter is an increment rate per unit bet; and said step of determining said current jackpot value, is carried out by incrementing an initial base value based on said increment rate per unit bet and said unit bet information from said gaming machines.

30. A method in accordance with claim 29 wherein: said increment rate per unit bet is randomly selected from between a maximum increment rate per unit bet and a minimum increment rate per unit bet.

31. A progressive controller for use in controlling a progressive jackpot system having a repeating game cycle, said progressive jackpot system during each game cycle providing a jackpot equal to a jackpot-win value and which can be won as a result of play on a plurality of gaming machines by one of said gaming machines, each gaming machine generating unit bet information indicative of a number of unit bets supplied to the machine for playing a game on the machine, said progressive controller including:

means for receiving unit bet information from said gaming machines; and progressive control means responsive to the receiving means and which during each game cycle: establishes at the beginning of the game cycle a jackpot-win value; enables said jackpot-win value to be displayed from said beginning of and during said game cycle; randomly establishes at the beginning of the game cycle a parameter for determining a current jackpot value; determines a current jackpot value based on unit bet information from the gaming machines and said randomly established parameter; and determines that a particular gaming machine has won the jackpot when the current jackpot value is brought to the jackpot-win value as result of unit bet information from the particular gaming machine.

32. A progressive controller in accordance with claim 31 wherein:

said progressive controller is for further use with a display means responsive to said progressive controller for displaying said jackpot-win value so as to be viewable by the players playing said gaming machines.

33. A progressive controller in accordance with claim 31 wherein:

said progressive control means communicates to the particular gaming machine that the particular gaming machine has won the jackpot.

34. A progressive controller in accordance with claim 31 wherein:

said progressive control means randomly establishes said jackpot-win value.

35. A progressive controller in accordance with claim 34 wherein:

said parameter is an initial base value for said current jackpot value; and said progressive control means determines said current jackpot value by incrementing said initial base value.

36. A progressive controller in accordance with claim 34 wherein:

said parameter is an increment rate per unit bet; and said progressive control means determines said current jackpot value by incrementing an initial base value based on said increment rate per unit bet and said unit bet information from said gaming machines.

37. A progressive controller in accordance with claim 34 wherein:

said progressive controller means randomly selects said jackpot-win value from between a maximum jackpot-win value and a minimum jackpot-win value.

38. A progressive controller in accordance with claim 31 wherein:

said progressive control means establishes the same jackpot-win value for each game cycle.

39. A progressive controller in accordance with claim 38 wherein:

said parameter is an initial base value for said current jackpot value; and said progressive control means determines said current jackpot value by incrementing said initial base value.

40. A progressive controller in accordance with claim 39 wherein:

said parameter is an increment rate per unit bet; and said progressive control means determines said current jackpot value by incrementing an initial base value based on said increment rate per unit bet and said unit bet information from said gaming machines.

41. A progressive controller in accoreance with claim 31 wherein:

said parameter is an initial base value for said current jackpot value; and said progressive control means determines said current jackpot value by incrementing said initial base value.

42. A progressive controller in accordance with claim 41 wherein:

said progressive control means randomly selects said initial base value from between a maximum initial base value and a minimum initial base value.

43. A progressive controller in accordance with claim 31 wherein:

said parameter is an increment rate per unit bet; and said progressive control means determines said current jackpot value by incrementing an initial base value based on said increment rate per unit bet and said unit bet information from said gaming machines.

44. A progressive controller in accordance with accordance with claim 43 wherein:

said progressive control means randomly selects said increment rate per unit bet from between a maximum increment rate per unit bet and a minimum increment rate per unit bet.

45. A method of operating a progressive controller, the progressive controller for use in controlling a progressive jackpot system having a repeating game cycle, said progressive jackpot system during each game cycle providing a jackpot equal to a jackpot-win value and which can be won as a result of play on a plurality of gaming machines by one of said gaming machines, each gaming machine generating unit bet information indicative of a number of unit bets supplied to the machine for playing a game on the machine; said method including for each generated game cycle;

receiving unit bet information from said gaming machines;

establishing at the beginning of the game cycle a jackpot-win value;

enabling said jackpot-win value to be displayed from said beginning of and during said game cycle;

radomly establishing at the beginning of the game cycle a parameter for determining a current jackpot value;

determining a current jackpot value based on unit bet information from the gaming machines and said randomly established parameter; and determining that a particular gaming machine has won the jackpot when the current jackpot value is brought to the jackpot-win value as a result of unit bet information from the particular gaming machine.

46. A method in accordance with claim 45 wherein:

said progressive controller is for further use with display means responsive to said progressive controller for displaying said jackpot-win value so as to be viewable by the players playing said gaming machines.

47. A method in accordance with claim 45 further comprising:

communicating to said particular gaming machine that the particular gaming machine has won the jackpot.

48. A method in accordance with claim 45 wherein:

said step of establishing said jackpot-win value is carried out randomly.

49. A method in accordance with claim 48 wherein:

said parameter is an initial base value for said current jackpot value; and said step of determining said current jackpot value is carried out by incrementing said initial base value.

50. A method in accordance with claim 48 wherein:

said parameter is an increment rate per unit bet, and said step of determining said current jackpot value is carried out by incrementing an initial base value based on said increment rate per unit bet and said unit bet information from said gaming machines.

51. A gaming system in accordance with claim 48 wherein:

said jackpot-win value is selected from between a maximum jackpot-win value and a minimum jackpot-win value.

52. A method in accordance with claim 45 wherein:

the same jackpot-win value is established for each game cycle.

53. A method in accordance with claim 52 wherein:
said parameter is an initial base value for said current jackpot value; and
said step of determining said current jackpot value is carried out by incrementing said initial base value.

54. A method in accordance with claim 52 wherein:
said parameter is an increment rate per unit bet; and
said step of determining said current jackpot value is carried out by incrementing an initial base value based on said increment rate per unit bet and said unit bet information from said gaming machines.

55. A method in accordance with claim 45 wherein:
said parameter is an initial base value for said current jackpot value; and
said step of determining said current jackpot value is carried out by incrementing said initial base value.

56. A method in accordance with claim 55 wherein:
said initial base value is randomly selected from between a maximum initial base value and a minimum initial base value.

57. A method in accordance with claim 45 wherein:
said parameter is an increment rate per unit bet; and
said step of determining said current jackpot value is carried out be incrementing an initial base value based on said increment rate per unit bet and said unit bet information from said gaming machines.

58. A method in accordance with claim 57 wherein:
said increment rate per unit bet is randomly selected from between a maximum increment rate per unit bet and a minimum increment rate per unit bet.

* * * * *